US007857547B1

(12) United States Patent
Summers et al.

(10) Patent No.: US 7,857,547 B1
(45) Date of Patent: Dec. 28, 2010

(54) DRAIN PANELS AND BLOCKS

(75) Inventors: Link E. Summers, Taos, NM (US); Orwill Hawkins, Tupelo, MS (US)

(73) Assignee: Link Holdings LLC, Reno, NV (US)

( * ) Notice: Subject to any disclaimer, the term of this patent is extended or adjusted under 35 U.S.C. 154(b) by 0 days.

(21) Appl. No.: 12/215,364

(22) Filed: Jun. 26, 2008

Related U.S. Application Data

(60) Provisional application No. 60/937,222, filed on Jun. 26, 2007.

(51) Int. Cl.
*E02B 11/00* (2006.01)

(52) U.S. Cl. ..... 405/45; 405/43; 405/50

(58) Field of Classification Search ..... 405/43–50, 405/36, 184.4
See application file for complete search history.

(56) References Cited

U.S. PATENT DOCUMENTS

| | | | | |
|---|---|---|---|---|
| 2,707,984 | A * | 5/1955 | Goff | 405/184.4 |
| 4,704,048 | A * | 11/1987 | Ahlgrimm | 405/45 |
| 5,100,258 | A * | 3/1992 | VanWagoner | 405/45 |
| 5,102,260 | A * | 4/1992 | Horvath et al. | 405/50 |
| 5,713,696 | A * | 2/1998 | Horvath et al. | 405/45 |
| 6,413,018 | B1 * | 7/2002 | Klaymar | 405/184.4 |
| 6,467,996 | B1 * | 10/2002 | Garner | 405/50 |
| 6,988,852 | B2 | 1/2006 | Bussey et al. | |
| 7,074,305 | B2 * | 7/2006 | Connors | 405/184.4 |
| 7,244,477 | B2 * | 7/2007 | Sawyer et al. | 428/17 |

OTHER PUBLICATIONS

White,, Kevin; *Assessment of Hardened EPS, Geosynthetic Trench Systems Under Various Soil Conditions in Alabama*; Final Report Jun. 28, 2001 pp. 1-9.

Robertson: *Survey and Study of Installed Expanded Polystyrene Aggregate Onsite Sewage Treatment and Disposal Systems in Georgia*; 2000 NOWRA Proceedings; pp. 265-272.

Robertson; *Evaluation of Seven Year Old EEE ZZZ Lay Effluent Drainfield Systems Installed in Two Feet Wide Trenches in the State of Texas*; EEE zzz Lay Drain Co., Inc. P.O.Box 639, Pisgah Forest, NC, 28768; pp. 1-11.

Anon.; *Drainage Panel Advertising Material*; GeoTech Systems Corporation, P.O. box 1045, Great Falls, VA 22066 pp. 1-5.

* cited by examiner

*Primary Examiner*—Frederick L Lagman
(74) *Attorney, Agent, or Firm*—James Creighton Wray

(57) ABSTRACT

A gravelless drainfield and drain panel product for all legal gravity and pressure dosed drain configurations for trenches, beds, mounds and elevated systems and foundation and other drain panel applications. The product allows for appropriate reduction in drainfield sizing. Individual pieces of expanded polymer aggregate with three or more fingers are connected where they touch to form a variety of rigid porous panels and blocks of randomly disposed, interconnected, high-surface-area, high-void space elements of light weight expanded polymer material. For the drainfield product, a main pipe for gravity, low-pressure dosing, or drip irrigation receives a flow of liquid in the form of wastewater effluent, gray water, irrigation water or run-off and is held in place by a positioner. A drain panel may be placed against a structure for structural drainage.

23 Claims, 11 Drawing Sheets

Quik Drain

Quik Drain

Quik Drain

Quik Drain
Detail of Pipe Cradle

Quik Drain

Quik Drain

DRAIN PANELS AND BLOCKS

This application claims the benefit of U.S. Provisional Application No. 60/937,222, filed Jun. 26, 2007, which is hereby incorporated by reference in its entirety.

FIELD OF THE INVENTION

The present invention relates to the field of drainage panels, drain fields and wastewater management.

BACKGROUND OF THE INVENTION

Drain fields are used to remove contaminants from wastewater. Typically, perforated pipes are buried in trenches and the wastewater is allowed to leach out of the pipes into the surrounding soil, which absorbs the wastewater and contaminants. The ability to handle a large flow rate of wastewater is desirable. Various aggregates have been installed in the trenches to aid dispersion and distribution of wastewater to the soil.

Drain panels may be laid up against buildings, foundations below grade, and for other drainage usages, to facilitate drainage and removal of water from the foundation or wall. These systems may have a pipe at the bottom to collect side-entering liquids that have flowed through the panel. High flow-through is again important in these applications.

Needs exist for improved drain field materials and drain panels with greater ease of handling and improved physical characteristics that allow a greater flow rate. Needs exist for improved drain field materials that quickly process large volumes of wastewater while removing contaminants from the wastewater more effectively.

SUMMARY OF THE INVENTION

A gravelless drainfield and drain panel product for all legal gravity and pressure dosed drain configurations for trenches, beds, mounds and elevated systems as well as foundation and other drain panel applications. The product allows for appropriate reduction in drainfield sizing. Individual pieces of expanded polymer aggregate with three or more fingers are connected where they touch to form a variety of rigid porous panels and blocks of randomly disposed, interconnected, high-surface-area, high-void space elements of light weight expanded polymer. A main pipe for gravity, low-pressure dosing, or drip irrigation receives a flow of liquid in the form of wastewater effluent, gray water, irrigation water or run-off and is held in place by a positioner. A drain panel product for drainage applications may or may not include such a pipe. An air diffuser connected to an air pump or compressor may be placed in a notch in one of the blocks to promote the growth of aerobic bacteria and to aid evapotranspiration. A layer of resin paper or geotextile fabric may cover the pipe and the top of a block.

The new drainage system has a mass of randomly disposed, interconnected, high-surface-area, high-void space elements of light weight expanded polymer material. Within the mass there are a variety of shapes having a multitude of void spaces therein for passage of water.

The mass may be in an elongated cubic shape or a flattened elongated rectangular shape, or may be another geometric shape to increase its interface with the surrounding soil or allow the passage of fluids. Where the mass is in an elongated cubic shape, the variety of shapes may include a semicircular, ovoid, cubic, trapezoidal, or other geometric shape. The expanded polymer elements may have a density of up to 2 pounds per cubic foot for different applications.

The drainage system may also have a main pipe for gravity, low-pressure dosing, or drip irrigation for receiving a flow of liquid in the form of wastewater effluent, gray water, irrigation water or run-off. The system may include a positioner to hold the pipe in place. The system may have an air diffuser connected to an air pump or compressor, in which case the mass includes a notch for the placement of the air diffuser to promote the growth of aerobic bacteria and to aid evapotranspiration. The system may have a layer of resin paper or geotextile fabric covering the pipe and the top of the mass. There may be a layer of backfill over and on the pipe.

In one embodiment, the mass can be cut, stacked or combined in any configuration or shape to accommodate differences in terrain or landscape. There may be a vertical cylindrical or other shaped opening in the mass to facilitate evapotranspiration or to provide a port for inspection or sampling. The system may have passages through the mass that divert flow to the outer sides of the mass for more even direct application of effluent to surrounding soils via sidewalls of a trench or bed. The drainage system may have heat tape or ducted warm air for heating the drainage system.

In on embodiment, the mass is placed against a structure that may be exposed to a liquid to displace liquid away from the structure. There may be a perforated or non-perforated pipe embedded in or adjacent to the mass for collecting and conveying liquid away from the structure. In a new method of using the drainage system, the mass is placed vertically, horizontally, or at an angle against a structure and the mass displaces liquid away from the structure.

The elements of light weight expanded polymer material may three or more fingers, and preferably six or more fingers, to maximize surface area and void space. The elements of light weight expanded polymer material may have a density of 0.5 lbs/cubic foot. The expanded polymer material may be expanded polystyrene. The elements of light weight expanded polymer material may include elements of light weight expanded polymer material having different numbers of fingers in order to vary the porosity of the mass.

In a new method of manufacturing the drainage system, loose fill extruded expanded polymer is steam chest molded into a light weight product of a variety of highly porous interconnected solid shapes.

In a new method of manufacturing the drainage system, loose expanded polymer is expanded and then molded into a variety of highly porous solid shapes interconnected by adhesive or mechanical attachment.

These and further and other objects and features of the invention are apparent in the disclosure, which includes the above and ongoing written specification, with the drawings.

DETAILED DESCRIPTION OF THE PREFERRED EMBODIMENTS

Figure 1:
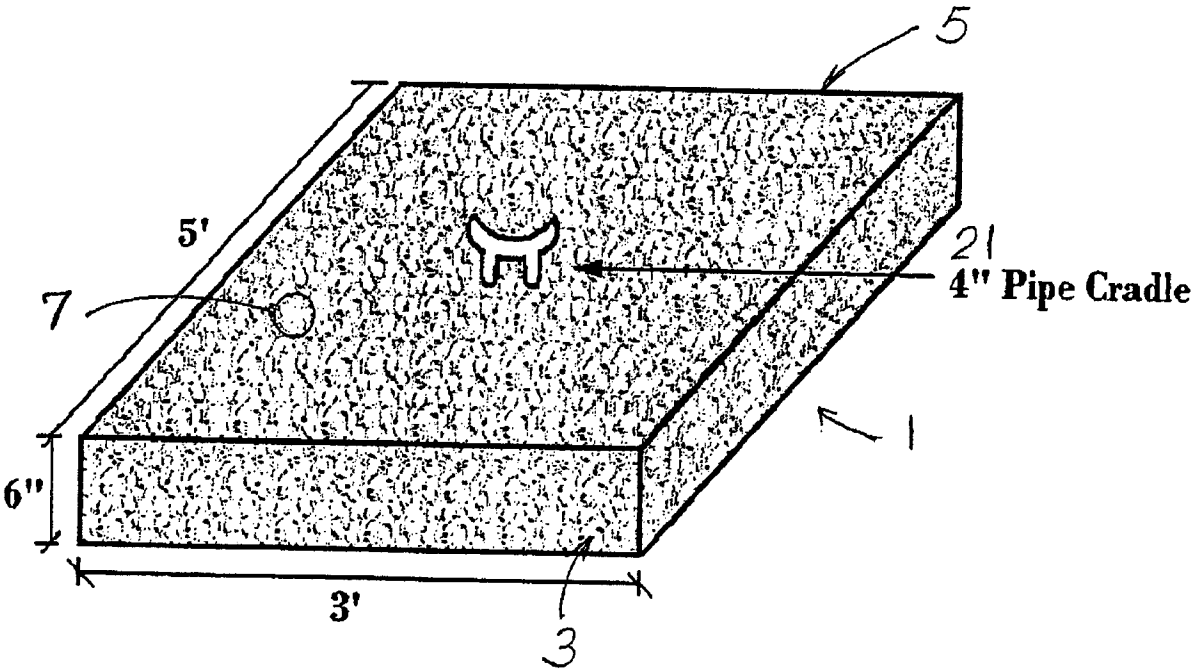
FIG. 1 is a drain panel for laying end to end in trenches.

The invention provides a proprietary gravelless drainfield and drain panel product for all legal gravity and pressure dosed drain configurations for trenches, beds, mounds and elevated systems. Optional enhancement of this drainfield product is provided by additional oxygen from a compressor or fan through aeration lines installed in the drainfield air channels. The invention provides for appropriate reduction in drainfield sizing.

The new aggregate comprises stuck together expanded polymer, such as expanded polystyrene (EPS), elements having three or more fingers optimized to maximize surface area and void space. The expanded elements and open construction provide increased surface areas for growth of desirable aerobic bacteria. The density of the expanded polymer is approximately 0.5 lbs/cubic foot. The expanded polymer aggregate material contains no fine material.

The individual pieces of expanded polymer aggregate are connected where they touch to form a variety of rigid porous panels and blocks which open vertically and horizontally with the following typical dimensions: 1 ft.×1 ft.×5 ft.; 6 in.×3 ft.×5 ft., or shorter. Blocks of the material may be combined or cut to construct any legal configuration of trench, bed, mound or elevated system. These blocks or panels can be made of a combination of differently shaped pieces of expanded polymer aggregate in order to vary the resulting void-space and hence porosity per volume. For example, some pieces may have three fingers while others may have eight or more. In general, the greater the number of fingers in the pieces, the less the porosity of the resulting block.

The new drains are used with gravity or low-pressure-dosed systems. Drain blocks include a chamber or channels at the bottom of each block. Perforated drain pipe or low-pressure-dosing pipe is held by a pipe cradle that is inserted into the top of the expanded polymer block. The drain pipe and expanded polymer blocks may be draped with geotextile fabric. Optional air lines connected to a compressor or fan are inserted in the channels and chambers in the drains to provide additional oxygen transfer to the drainfield.

The product is a conjoined expanded polymer (or other plastic or other material) porous dimensional block for the treatment and disposal of effluent from on-site and other wastewater systems. It would include all legal configurations of disposal systems, including trenches, beds, mounds, elevated systems and evapotranspiration systems.

The addition of an air line enhances the treatment utility of the product and promotes evapotranspiration. The cavity or chamber is used in a number of other drainfield products. The central arched channel may be semicylindrical and may additionally have a central support. The expanded shapes provide surfaces for colonization of aerobic bacteria. The channel may be provided with branched perforated tubes connected to the output of a small periodically operated air compressor. The entire assembly may be covered with geotextile fabric.

For a drain panel structural drainage application, there typically is no main pipe with positioner, but a bottom pipe may be incorporated to collect side entering liquids that have flowed through the panel. The uniquely shaped expanded polymer aggregate facilitates improved flow-through and drainage.

For cold climate or weather applications below freezing or where installations are above the frost line the entire assembly may be heated using heat tape or ducted warmed air.

The drainfield product may be used with gravity, low-pressure dosing, or drip irrigation disposal systems. Gravity systems are simply septic tanks that flow by gravity from the septic tank to the drainfield. The inlet (where the water comes in) of the septic tank is higher than the outlet (where the water leaves the tank). Low-pressure dosing systems may be used to achieve uniform distribution of wastewater over an entire infiltrative surface. Effluent from this type of system is pumped under low pressure through solid pipe into perforated lateral lines installed within a disposal system. Drip irrigation systems are used to water trees and grass (below the surface of the ground) with treated wastewater.

FIG. 1 is a drain panel 1 having a cradle 21 for holding a foraminous drain pipe for laying end 3 to end 5 in trenches. A vertical opening 7, which may be cylindrical or of other shape, is provided in the mass to facilitate evapotranspiration or to provide a port for inspection or sampling.

Figure 2:
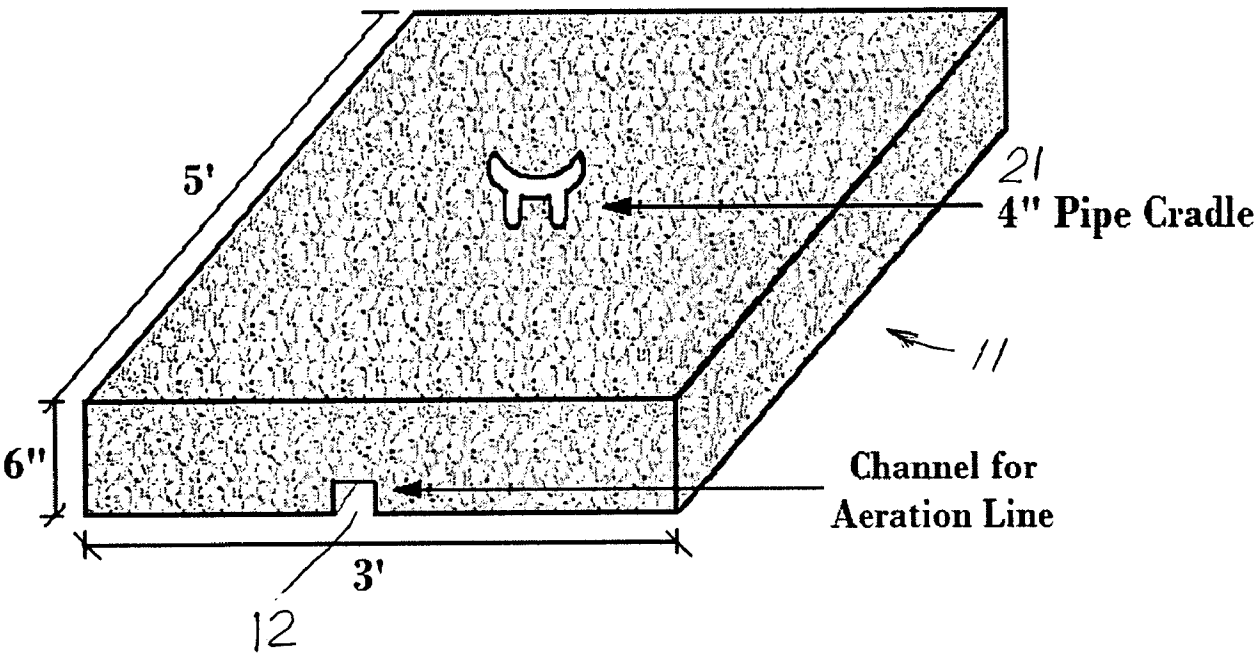
FIG. 2 is a drain panel having an air channel.

FIG. 2 is a drain panel 11 having an air channel 12.

Figure 3:
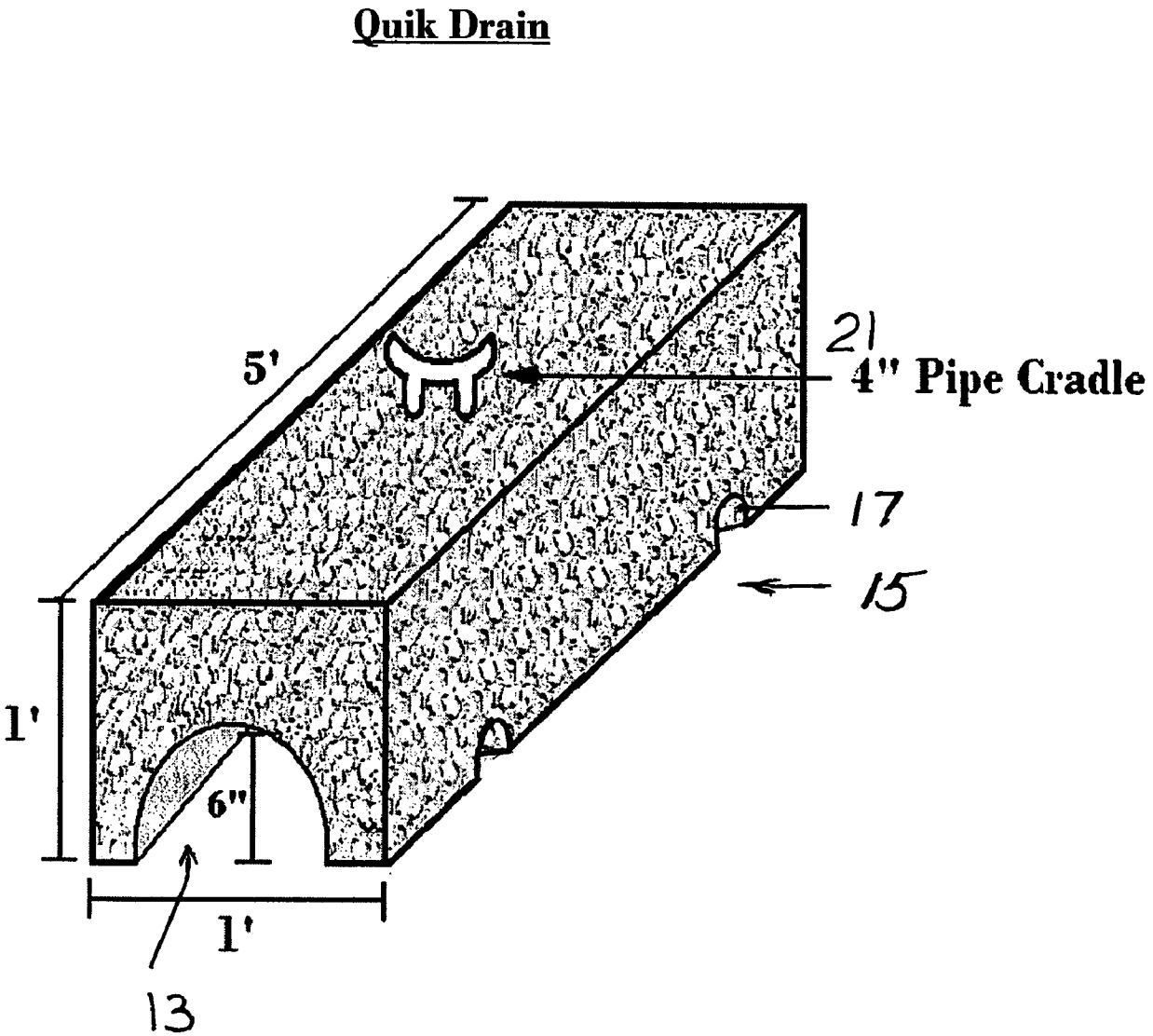
FIG. 3 is a drain panel block having an air chamber for laying end to end in trenches.

FIG. 3 is a drain panel block 15 having an air chamber 13 for laying end to end in trenches. Passages 17 through blocks 15 divert flow to the outer sides of the blocks.

Figure 4:
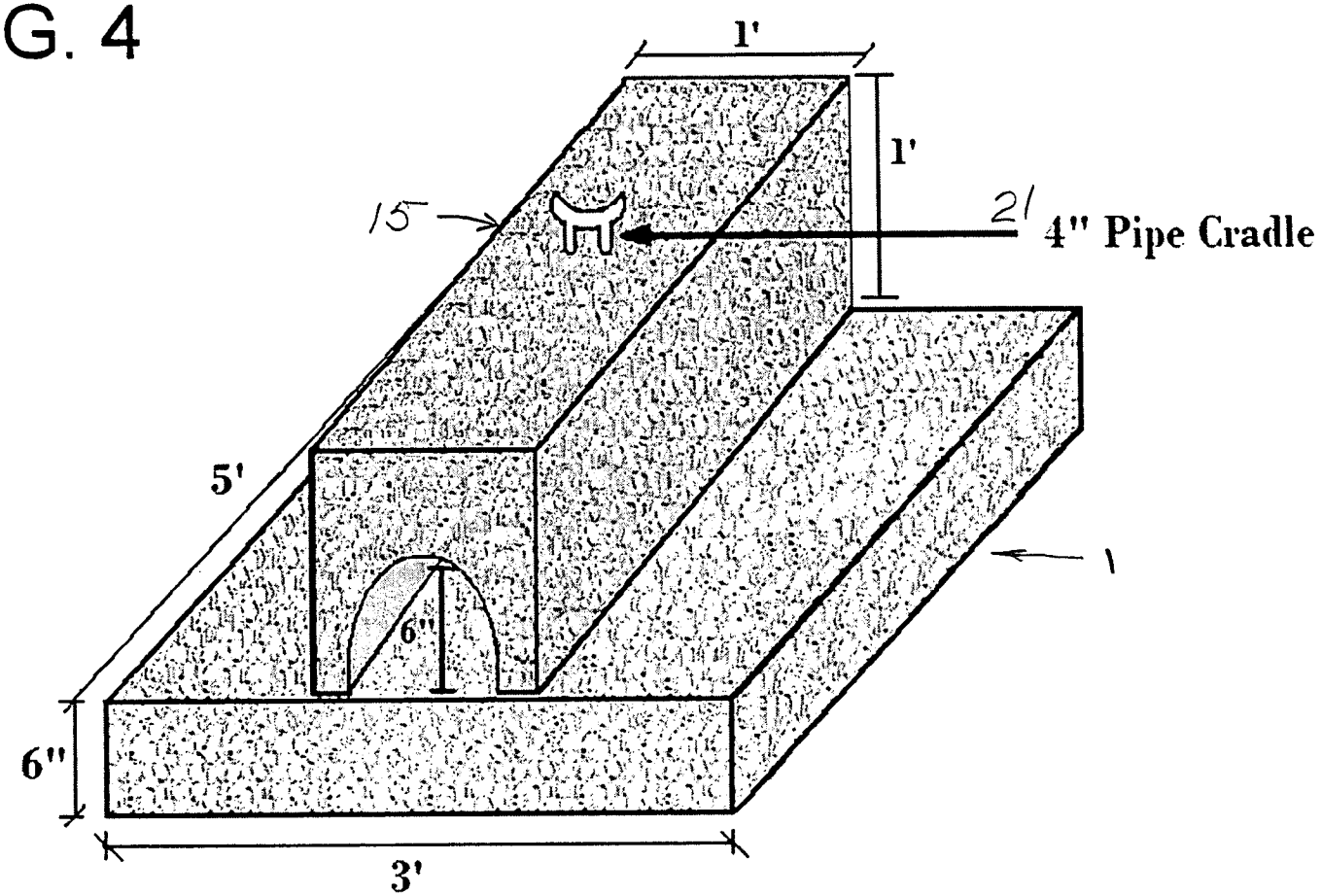
FIG. 4 shows a drain block installed on top of a drain panel.

FIG. 4 shows a drain block 15 installed on top of a drain panel 1.

Figure 5:
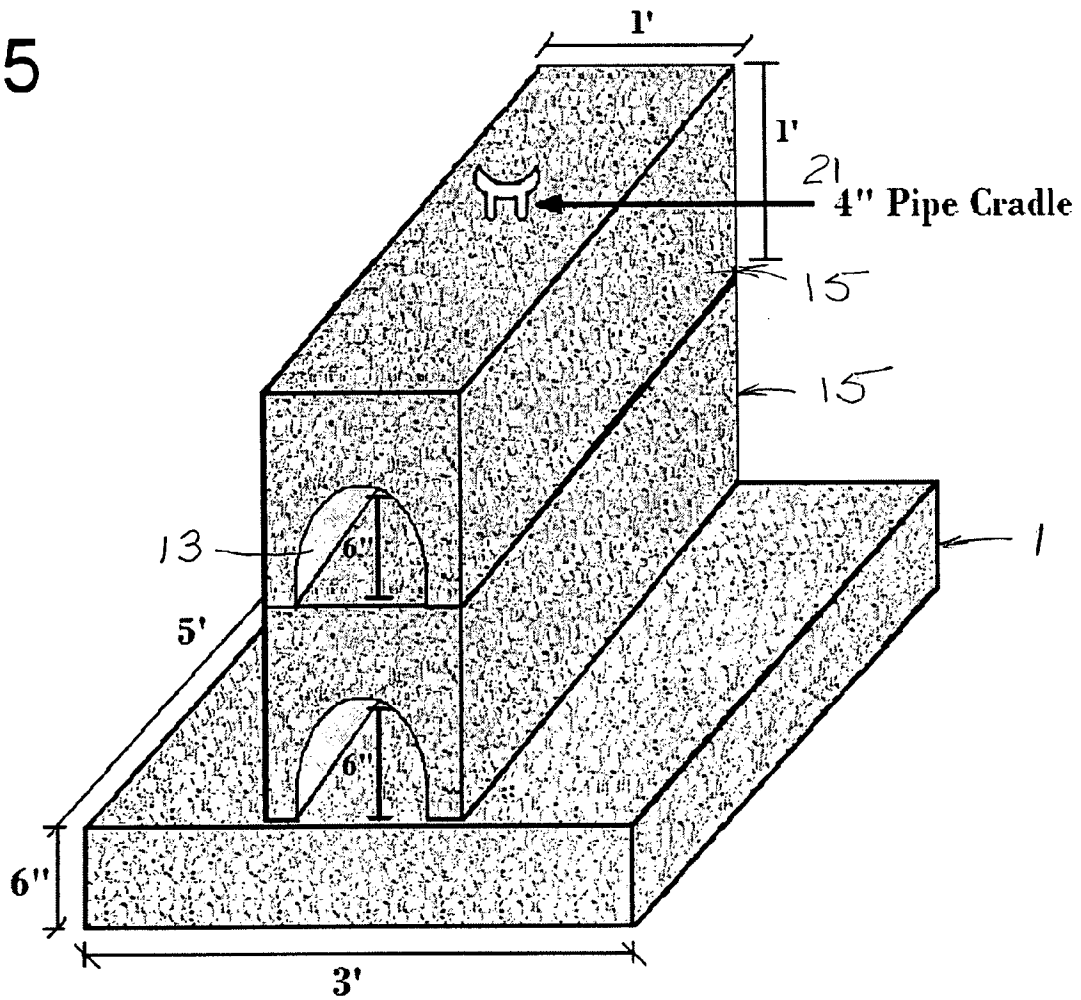
FIG. 5 shows drain blocks installed on top of a drain panel.

FIG. 5 shows drain blocks 15 installed on top of a drain panel 1.

Figure 6:
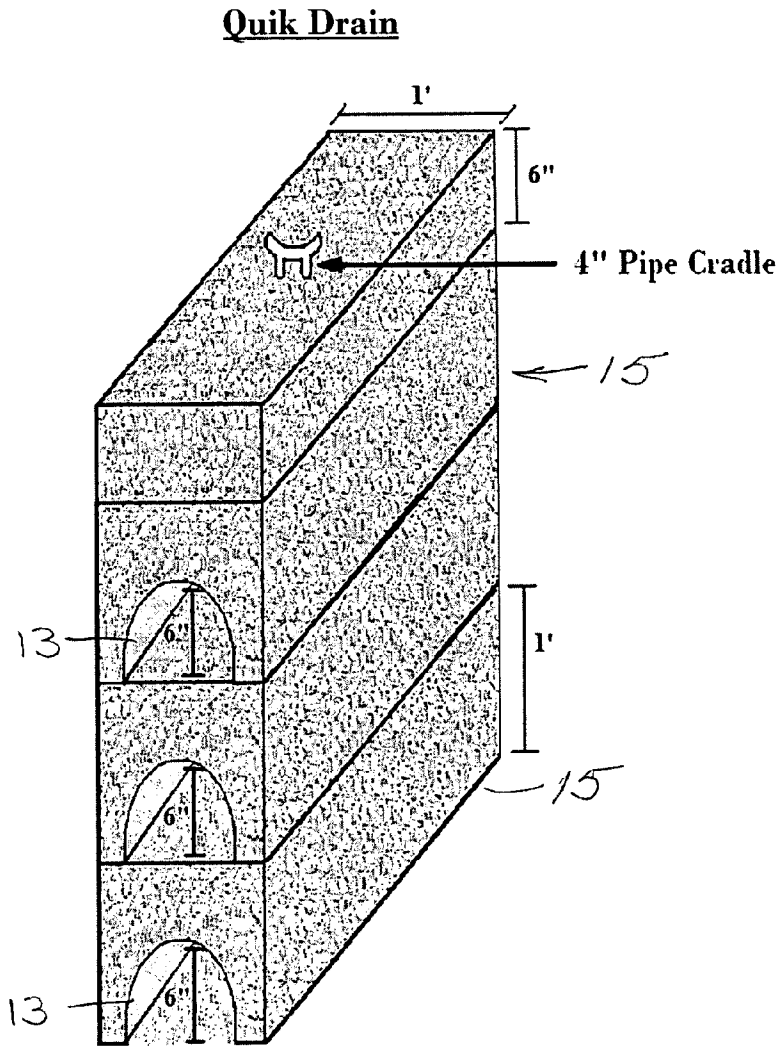
FIG. 6 shows blocked drain blocks for laying end to end in trenches.

FIG. 6 shows multiple stacked drain blocks 15 for laying end to end in trenches. The drain blocks may be alternately overlapped such as bricks or blocks in a wall for stabilization.

Figure 7:
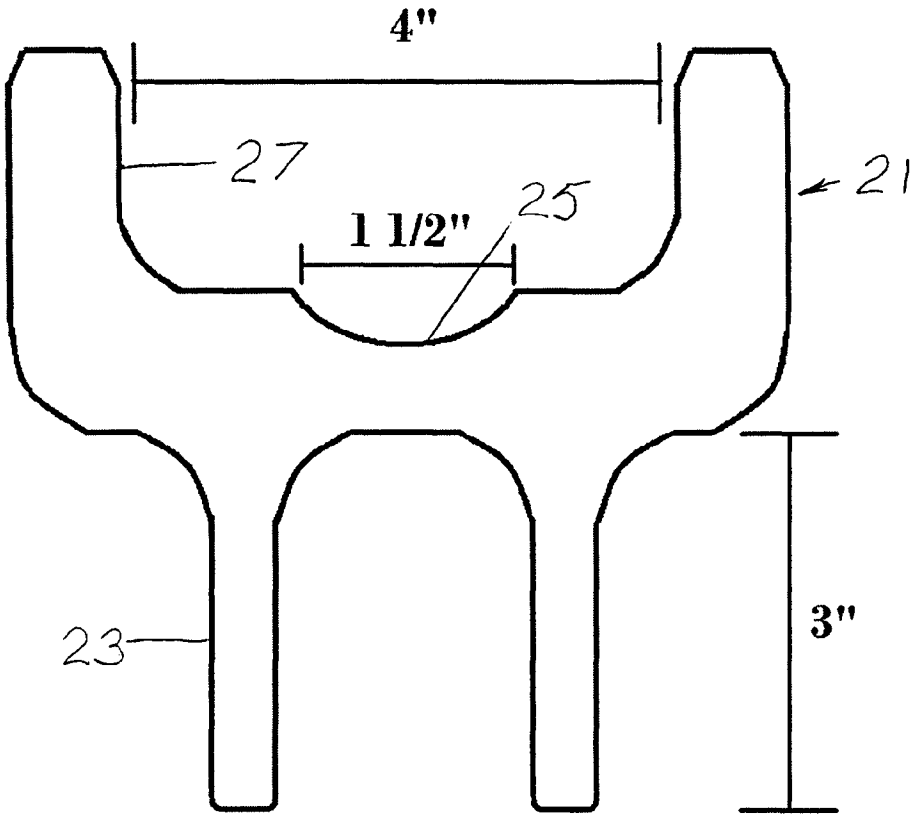
FIG. 7 shows a drain pipe cradle.

FIG. 7 shows a drain pipe cradle 21 having legs 23 for inserting in a panel and block and having a U-shaped drain pipe holder 25 between upward pipe stabilizing arms 27.

Figure 8:
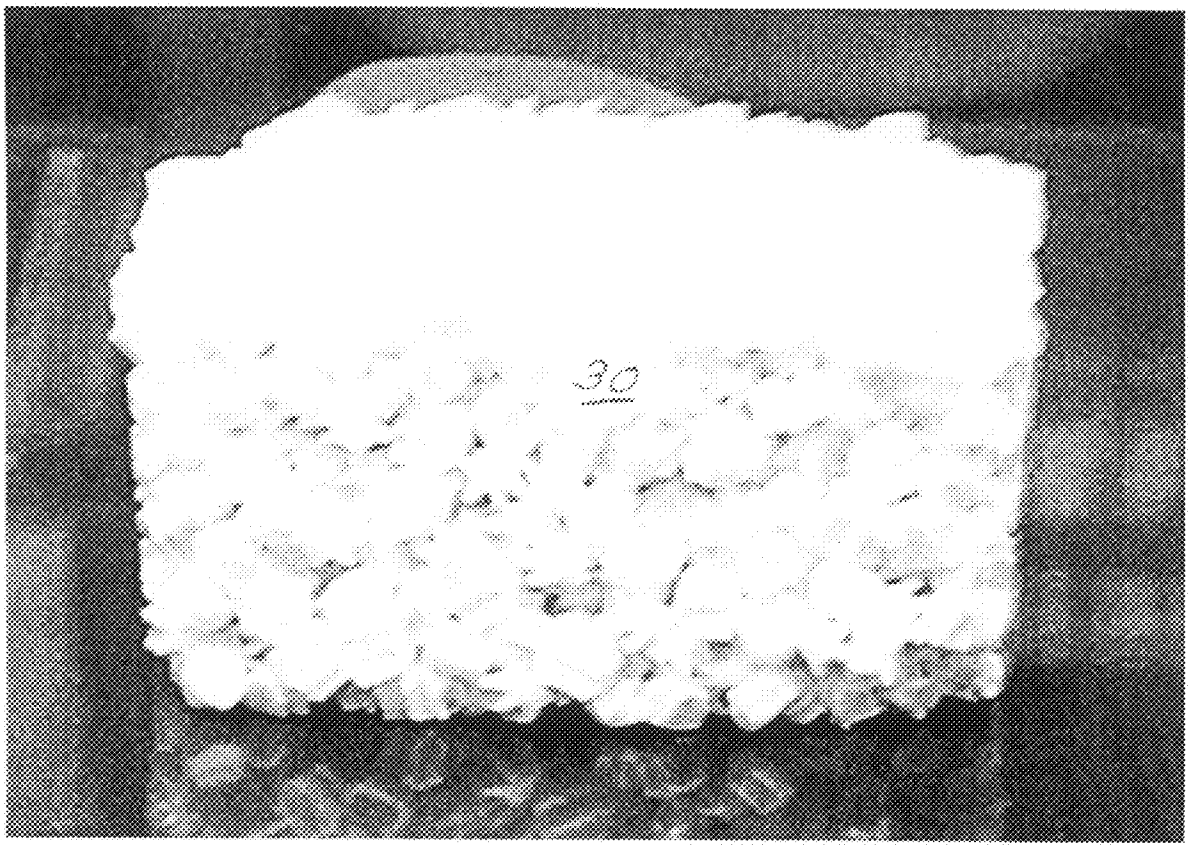
FIG. 8 shows composition of the blocks and panels.

FIG. 8 shows composition 30 of the blocks 15 and panels 1, 11.

Figure 9:
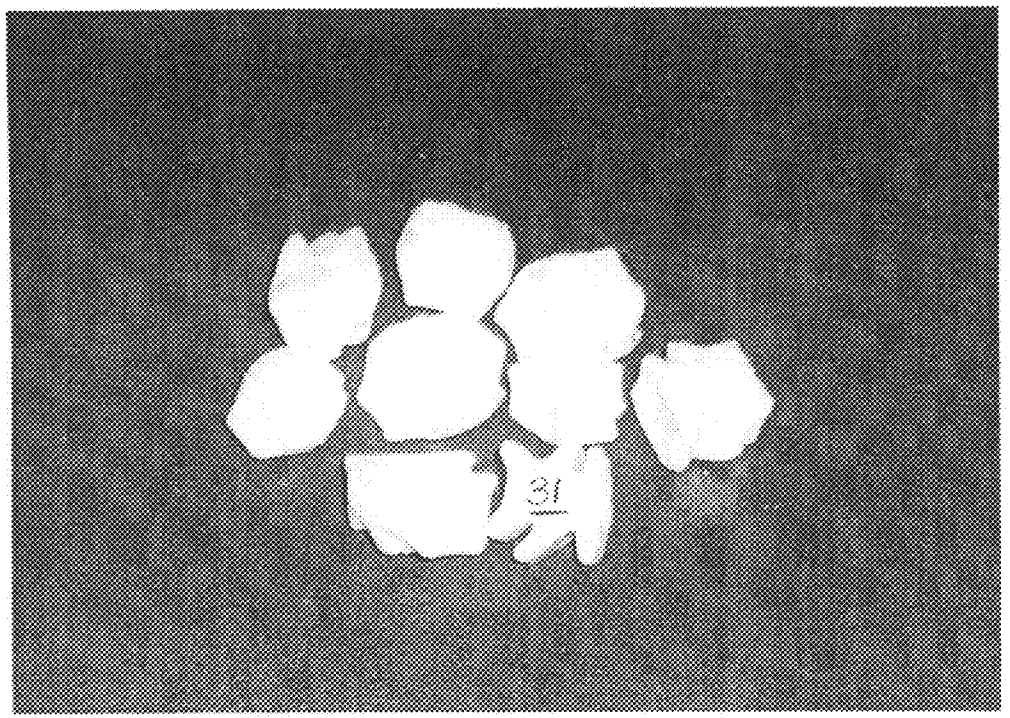
FIG. 9 shows elements which are adhered together to form the panels and blocks.

FIG. 9 shows elements 31 which are adhered together to form the panels 1, 11 and blocks 15.

Figure 10:
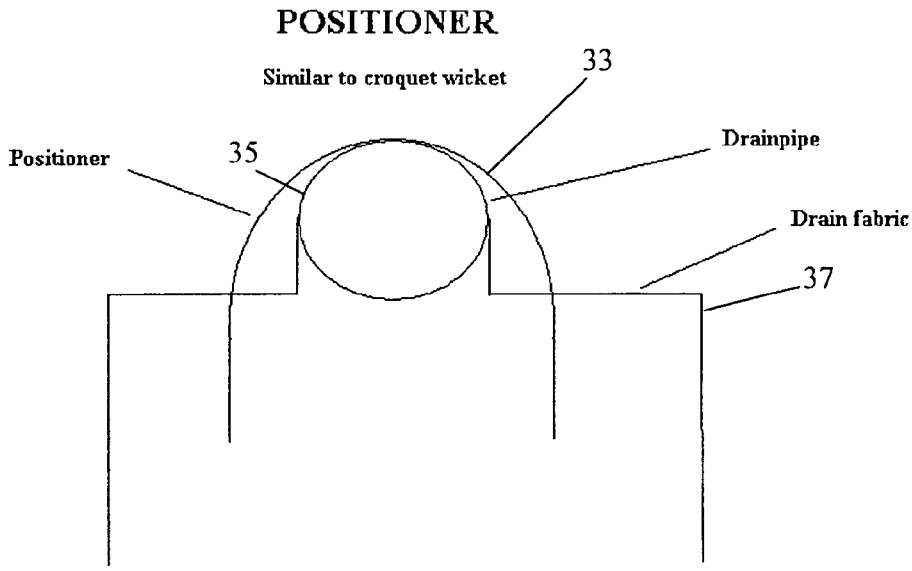
FIG. 10 shows a positioner holding a drainpipe in place and a drain fabric draped over the drainpipe.

FIG. 10 shows a positioner 33 holding a drainpipe 35 in place and a drain fabric 37 draped over the drainpipe 35.

Figure 11:
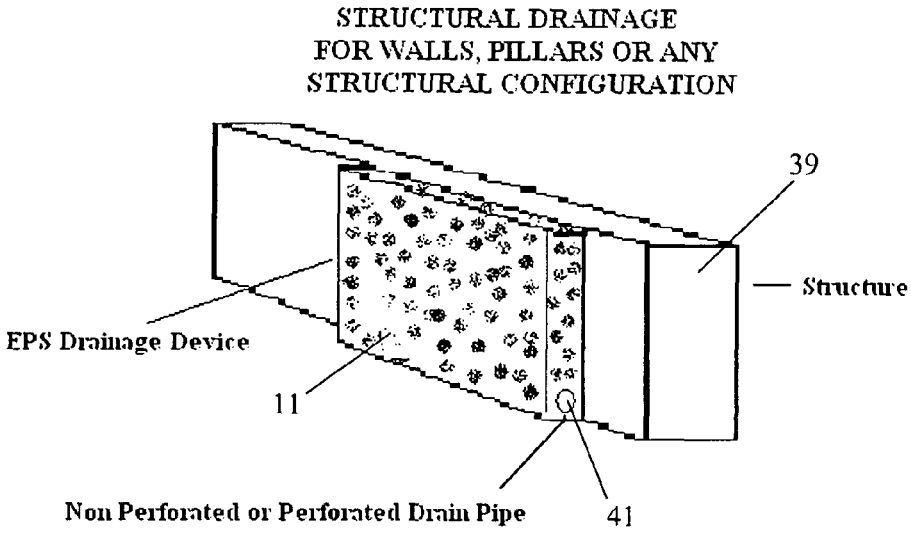
FIG. 11 shows a drain panel used for structural drainage.

FIG. 11 shows a drain panel 11 used for structural drainage. The drain panel 11 is placed against a wall, post, pillar, column or other structure 39. Water flowing down the side of the structure enters the drain panel and is diverted away from the base of the structure, preventing the structure from being exposed to liquid or moisture that could weaken or harm it. Structural drainage may be useful for buildings, bridges, footings, and other architectural and engineering applications. The system is especially useful for improving removal or transmission of any non-reactive liquid away from a structure.

A perforated or non-perforated drain pipe 41 will be included at the bottom of the drain panel in some applications. This pipe diverts water that has trickled through the drain panel to the base of the structure. The pipe may instead be placed adjacent to and at varying distances from the vertically placed drain panel, or may be located within a horizontally or angularly placed drain block or panel placed in contact with the vertical drain panel.

Extrusion of Polystyrene Beads

Crystal polystyrene is mixed with compounds including nucleating agents and blowing agents into an extruder through a die with the profile of the part to be made. The mix of agents enables the individual parts that comprise the final product to adhere to each other. The bead is cooled in a water bath cooler to stop expansion. The extruded material is pulled through a cutter which cuts the bead to the desired length.

Processing (Expansion)

The polystyrene bead is expanded two times to achieve the desired density. The expanded polystyrene is then aged to stabilize it.

Steam Chest Molding

The aged expanded polystyrene loose fill parts are placed in a mold inside a steam chest, where they are again exposed to steam. The parts begin to expand, exerting force, but retain their shape with some reduction in void space. The heat softens the surface of the parts, which enables the point of contact surfaces to adhere to each other, forming a solid porous mass with a variety of cavities and passages. The design of the shape and size of chambers, passages, and core vents into the mold enables the performance of the different functions by the final product.

While the invention has been described with reference to specific embodiments, modifications and variations of the invention may be constructed without departing from the scope of the invention.

We claim:

1. A wastewater treatment dispersal and disposal system, comprising:

blocks of randomly disposed, interconnected, high-surface-area, high-void space elements of light weight expanded polymer material, and air chambers formed in bottoms of the blocks, wherein within the blocks there are a variety of similar shapes having a multitude of void interconnected spaces providing controlled passage of water and air through the interconnected void spaces in the blocks to allow biological agents attach and grow on surface of the elements to degrade and decompose contaminants in the waste water.

2. A system as set forth in claim 1, wherein the mass is in an elongated cubic shape.

3. A system as set forth in claim 1, wherein the mass is in a flattened elongated rectangular shape.

4. A system as set forth in claim 1, wherein the mass has a geometric shape to increase its interface with the surrounding soil.

5. A system as set forth in claim 1, wherein the variety of shapes includes a semicircular, ovoid, cubic, trapezoidal, or other geometrically shaped cavity on the bottom of the mass.

6. A system as set forth in claim 1, wherein said expanded polymer elements have a density of up to 2 pounds per cubic foot for different applications.

7. A system as set forth in claim 1, further comprising a main pipe for gravity, low-pressure dosing, or drip irrigation disposal systems for receiving a flow of liquid in the form of wastewater effluent, gray water, irrigation water or run-off.

8. A system as set forth in claim 7, further comprising a positioner to hold the pipe in place.

9. A system as set forth in claim 7, further comprising a layer of resin paper or geotextile fabric covering the pipe and the top of the mass.

10. A drainage system as set forth in claim 7, further comprising a layer of backfill over and on the pipe.

11. A method of manufacturing the system of claim 1, comprising:

steam chest molding loose fill extruded expanded polymer into a light weight, the blocks of the elements with the air chambers formed on the bottom of the blocks.

12. A system as set forth in claim 1, wherein the mass can be cut, stacked or combined in any configuration or shape to accommodate differences in terrain or landscape.

13. A system as set forth in claim 1, further comprising passages through the mass that divert flow to the outer sides of the mass for more even direct application of effluent to surrounding soils via sidewalls of a trench or bed.

14. A method of manufacturing the system of claim 1, comprising:

expanding and then molding the elements of expanded polymer into blocks interconnected by adhesive or mechanical attachment in to the blocks having the air chambers and the interconnected void spaces.

15. A system as set forth in claim 1, wherein the elements of light weight expanded polymer material comprise three or more protrusions to maximize surface area and void space.

16. A system as set forth in claim 1, wherein the elements of light weight expanded polymer material have a density of 0.5 lbs/cubic foot to 2.5 lbs/cubic foot.

17. A system as set forth in claim 1, wherein the expanded polymer material is expanded polystyrene.

18. A system as set forth in claim 1, wherein the elements of light weight expanded polymer material comprise elements of light weight expanded polymer material having different numbers of protrusions in order to vary the porosity of the mass.

19. A system as set forth in claim 1, further comprising a structure that may be exposed to a liquid, wherein the mass is placed against the structure to displace liquid away from the structure.

20. A system as set forth in claim 19, further comprising a perforated or non-perforated pipe embedded in or adjacent to the mass for collecting and conveying liquid away from the structure.

21. A system comprising:

a mass of randomly disposed, interconnected, high-surface-area, high-void space elements of light weight expanded polymer material, wherein within the mass there are a variety of similar shapes having a multitude of void spaces therein for passage of water, further comprising an air diffuser connected to an air pump or compressor, wherein the mass includes a notch for the placement of the air diffuser to promote the growth of aerobic bacteria and to aid evapotranspiration.

22. A system comprising:

a mass of randomly disposed, interconnected, high-surface-area, high-void space elements of light weight expanded polymer material, wherein within the mass there are a variety of similar shapes having a multitude of void spaces therein for passage of water, further comprising a vertical cylindrical or other shaped opening in the mass to facilitate evapotranspiration or to provide a port for inspection or sampling.

23. A drainage system comprising:

a mass of randomly disposed, interconnected, high-surface-area, high-void space elements of light weight expanded polymer material, wherein within the mass there are a variety of similar shapes having a multitude of void spaces therein for passage of water, further comprising heat tape or ducted warm air for heating the drainage system.

* * * * *